US008336236B2

(12) United States Patent
Boltz et al.

(10) Patent No.: US 8,336,236 B2
(45) Date of Patent: Dec. 25, 2012

(54) BLEACHER ADVERTISING DISPLAY SYSTEM

(75) Inventors: Eric S. Boltz, Akron, OH (US); Scott A. Miller, Navarre, OH (US); Erik M. Baker, Massillon, OH (US)

(73) Assignee: Imaginethis Renovations, LLC, Navarre, OH (US)

( * ) Notice: Subject to any disclaimer, the term of this patent is extended or adjusted under 35 U.S.C. 154(b) by 80 days.

(21) Appl. No.: 12/892,129

(22) Filed: Sep. 28, 2010

(65) Prior Publication Data

US 2012/0073169 A1 Mar. 29, 2012

(51) Int. Cl.
*G09F 17/00* (2006.01)

(52) U.S. Cl. ..... 40/604; 40/603

(58) Field of Classification Search ..... 40/603, 40/604, 607.01; 160/399, 402; 248/228.1; 52/234, 235, 238.1, 239, 6, 8
See application file for complete search history.

(56) References Cited

U.S. PATENT DOCUMENTS

| | | | | |
|---|---|---|---|---|
| 2,540,584 | A | 2/1951 | Jaycox | |
| 3,537,201 | A | 11/1970 | Huey et al. | |
| 3,589,048 | A | 6/1971 | Mollet | |
| 4,375,134 | A | 3/1983 | Sheetz | |
| 4,879,848 | A * | 11/1989 | Gardner et al. | 52/8 |
| 4,890,403 | A * | 1/1990 | Dinan | 40/604 |
| 4,932,152 | A | 6/1990 | Barlotta et al. | |
| 5,090,145 | A | 2/1992 | Chiang et al. | |
| 5,246,194 | A * | 9/1993 | Garcia | 248/228.1 |
| 5,305,704 | A | 4/1994 | Olaniyan | |
| 5,333,425 | A * | 8/1994 | Nickerson et al. | 52/222 |
| 5,402,988 | A | 4/1995 | Eisele | |
| 5,407,178 | A | 4/1995 | Long | |
| 5,555,659 | A * | 9/1996 | Hade | 40/604 |
| 5,667,855 | A | 9/1997 | Borden et al. | |
| 5,685,099 | A | 11/1997 | Favata | |
| 5,732,494 | A * | 3/1998 | Davey | 40/604 |
| 5,916,091 | A * | 6/1999 | Schultz | 52/8 |
| 5,921,031 | A * | 7/1999 | Williams | 52/8 |
| 6,474,009 | B2 | 11/2002 | Hahn | |
| 6,510,663 | B2 * | 1/2003 | Jourden et al. | 52/238.1 |
| 6,530,165 | B2 * | 3/2003 | Griesemer et al. | 40/603 |
| 6,619,544 | B2 | 9/2003 | Bator et al. | |
| 6,719,276 | B1 | 4/2004 | Bush | |
| 7,240,637 | B2 | 7/2007 | Rosen | |
| 7,437,843 | B2 | 10/2008 | Lefebvre | |
| 7,997,560 | B2 | 8/2011 | Bergdoll | |
| 2004/0221972 | A1 * | 11/2004 | Tomlinson et al. | 160/327 |
| 2007/0209261 | A1 | 9/2007 | Stover et al. | |
| 2009/0266958 | A1 | 10/2009 | Meersman et al. | |

* cited by examiner

*Primary Examiner* — James Kramer
*Assistant Examiner* — Christopher e Veraa
(74) *Attorney, Agent, or Firm* — Sand & Sebolt

(57) ABSTRACT

A bleacher advertising display system including a bleacher having a seating surface and a plurality of support beams that define an external vertical surface along one or more of the left side, rear side and right side of the bleacher. An advertising panel having advertising indicia thereon is engaged with a carrier and secured by way of a frame member to the support beams in such a way that the advertising panel is displayed along the external vertical surface. The frame member is adjustable to maintain the tension in the advertising panel so that the indicia are clearly displayed.

21 Claims, 14 Drawing Sheets

BLEACHER ADVERTISING DISPLAY SYSTEM

BACKGROUND OF THE INVENTION

1. Technical Field

The invention relates generally to an advertising display for stadiums and bleachers. More particularly, the invention relates to a system for displaying advertising panels which are securable to the back and sides of a stadium bleacher. Specifically, the invention relates to an advertising panel mounted and tensioned on the perimeter of the back and sides of the bleacher by one or more frame members.

2. Background Information

Advertising is a large industry in the United States and includes both printed media and electronic formats. Printed media comes in a variety of forms and may include banners and advertising billboards.

While advertising banners or panels are well known in the advertising industry, they are generally held in place with eyelets welded in the corners of the banner and string or yarn secured through the eyelet to a pole. The banner length then must be precise to fit within the area defined by the support poles or an unsightly amount of string will be necessary to secure the advertising panel to the pole. Advantageously, the use of string to secure the banner makes removal and replacement extremely easy for both the owner, as well as for, vandals or thieves.

Banners are traditionally used in smaller venues such as high school football stadiums, along fences, or the back of a bleacher. As discussed above, traditional eyelets are typically used to secure the banner to the fence or bleacher. While the advertising banners may adequately display an image, they do not appear professional or particularly pleasing to the audience.

Further, bleachers include open backs and sides which may be hazardous to pedestrians and children. In particular, children may be enticed to play within the support structure of the bleachers and become injured. The side and backs of the bleachers are also very unaesthetic in that there is a plurality of support structure designed for supporting the weight of the spectators and is generally not pleasing to look at.

SUMMARY OF THE INVENTION

The present invention broadly comprises a bleacher advertising display system that includes a bleacher having a seating surface and a plurality of support beams that defining an external vertical surface on the bleacher. An advertising panel having indicia thereon is engaged with a carrier and secured to by one or more frame members to the support beams so that the advertising panel is displayed along the external vertical surface of the bleacher. The frame members are adjustable to maintain the tension in the advertising panel.

The present invention also broadly comprises a method of displaying advertising including the steps of providing an advertising pane, engaging the panel with a carrier, attaching a frame member to a support beam that comprises part of an external vertical surface of the bleacher, attaching a rod to the frame member, coupling an advertising track with the carrier, and securing the advertising track to the rod. The method further includes the step of adjusting the tension on the adverting panel by changing the length of the rod that extends outwardly from the frame member.

BRIEF DESCRIPTION OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

The advertising display system of the present invention is indicated generally at 20, and is particularly shown in FIGS. 1 through 11. Display system 20 includes a panel fastening assembly and an advertising panel 32 that is selectively engageable therewith.

Figure 1:
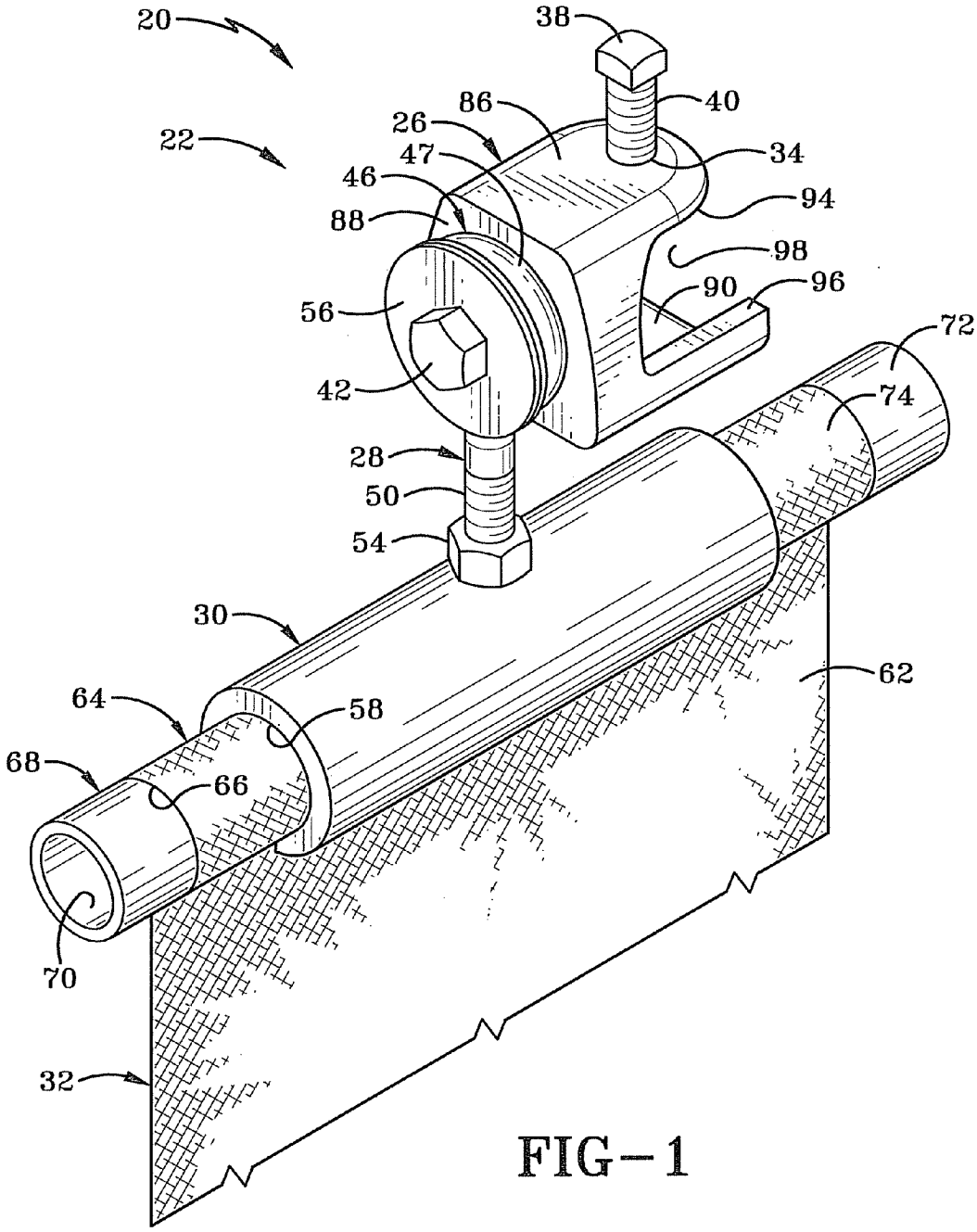
FIG. 1 is a perspective view of a first preferred embodiment of a panel fastening assembly used in an advertising display system in accordance with the present invention.
Figure 2:
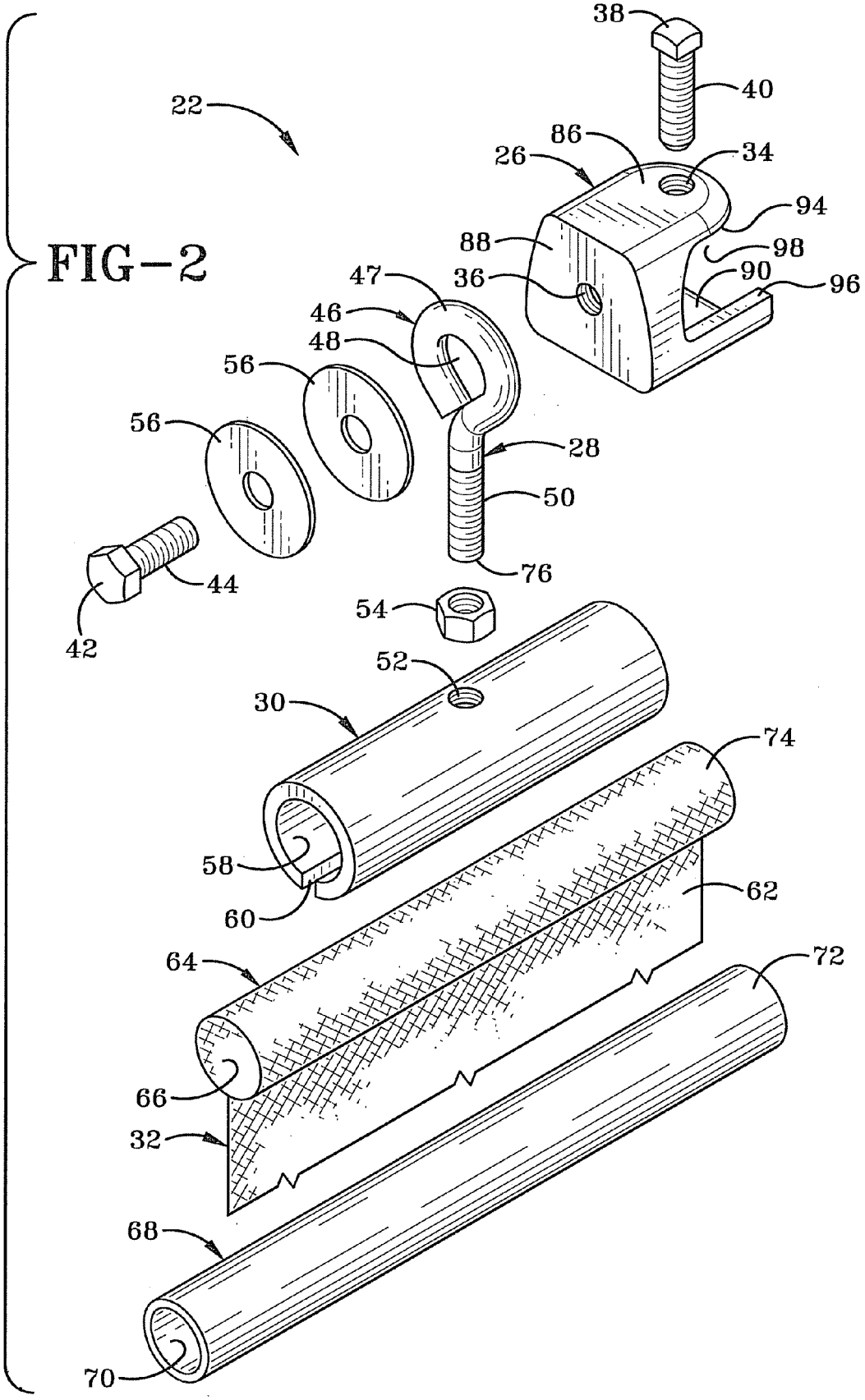
FIG. 2 is an exploded view of the panel fastening assembly of FIG. 1.

FIGS. 1 and 2 show a first preferred embodiment of a panel fastening assembly in accordance with the present invention, with the assembly being generally indicated at 22. Panel fastening assembly 22 comprises a frame member 26, a rod 28, an advertising track 30, and a carrier 68 configured to retain advertising panel 32 therein.

Frame member 26 is generally C-shaped in profile and includes a top wall 86, a rear wall 88, and a bottom wall 90. Top wall 86 defines top hole 34, rear wall 88 defines a rear hole 36, and bottom wall 90 defines a bottom hole 92. Bottom hole 92 is arranged parallel to top hole 34 but preferably is offset relative thereto to allow for the removable attachment of frame member 26 to flange 80 of beam 78 as will be described hereafter. Each of the top hole 34, rear hole 36, and bottom hole 92 is threaded. Both of the top hole 34 and bottom hole 92 are threaded to receive mounting bolt 38 therein. Rear hole 36 is threaded to receive bolt 42 therein. Bolt 38 has threads 40 to mate with one of top and bottom holes 34, 92 and bolt 42 has threads 44 to mate with rear hole 36.

Rod 28 may include a head 46 having a generally circular portion 47 with an opening 48 sized to receive bolt 42 therethrough. Rod 28 includes threads 50 arranged to be mated with a hole 52 in advertising track 30. Rod 28 is secured in a final position on track 30 with a lock nut 54 which may be any traditional type of nut and does not require a specific nylon stop of a lock nut. In the preferred embodiment, a pair of washers 56 is used in conjunction with bolt 42 to secure rod head 46 to frame member 26 via rear hole 36. Advertising track 30 is rotatable about rod 28 and therefore may be configured in a variety or orientations relative to frame member 26. Furthermore, when rod 28 is rotated in a first direction the circular portion 47 thereof moves closer toward an exterior surface of advertising track 30. When rod 28 is rotated in a second direction, the circular portion 47 thereof moves further away from the exterior surface of advertising track 30. Thus, the distance between advertising track 30 and rod 28, and therefore between track 30 and frame member 26 is adjustable by rotating rod 28 in either of the first and second directions.

In accordance with one of the main features of the invention, advertising track 30 preferably is generally tubular and has a chamber 58 which communicates with a longitudinally aligned slot 60 defined in track 30 opposite threaded hole 52. Advantageously, rod 28 can extend partially into chamber 58 of advertising track 30 to act as a locking mechanism for articles or devices that are disposed within chamber 58.

Advertising panel 32 preferably is composed of a sheet material, such as vinyl and may include a plurality of small holes therein that permit air to pass through panel 32 without damaging the material thereof. Although advertising panel 32 is shown and described as being composed of a vinyl material, any suitable material known in the art may be used without departing from the spirit and scope of the present invention as claimed. Advertising panel 32 has a top end, a bottom end, and first and second sides extending between the top and bottom ends. The sheet material of panel 32 is folded back upon itself at the top end and is secured in place by a seam 82 (FIG. 3) to form a ring 64. Ring 64 defines an inner bore 66 therein. The sheet material of panel 32 preferably is also folded back upon itself at the bottom end and is secured in place by a seam to form a second ring. Alternatively or additionally, the sheet material at one or both of the first and second sides is folded back upon itself and secured in place by a seam to form additional rings 64. The advertising panel 32 may therefore have one, two, three or four rings 64 around its perimeter. The area of the panel 32 disposed inwardly of these rings constitutes an advertising portion 62 upon which text and/or designs may be applied or incorporated.

In accordance with one of the main features of the invention, a carrier 68 is provided to engage ring 64. Carrier 68 preferably is generally tubular and defines an inner passage 70 which extends through the length of carrier 68. Unlike advertising track 30, inner passage 70 preferably does not include a slot, although one may be incorporated without departing from the spirit and scope of the present invention. Although carrier 68 is shown and described as being generally tubular, it will be understood that any other cross-sectional configuration may be utilized without departing from the spirit and scope of the present invention as claimed. Carrier 68 is received within bore 66 of ring 64 on advertising panel. An outer surface 72 of carrier 68 is disposed proximate an inner surface the ring 65 that defines bore 66. Carrier 68 and ring 64 are complementary shaped and sized to have a tight fit but the components preferably do not have an interference fit and, consequently, carrier 68 can be removed from bore 66 if desired.

Once carrier 68 is secured within bore 66, advertising track 30 is slidably engaged with ring 64 such that advertising portion 62 of panel 32 extends outwardly through slot 60 of advertising track 30. When this occurs, the outer surface 74 of ring 64 is located within chamber 58 of advertising track 30 and is disposed adjacent the interior surface of track 30 that defines chamber 58. Rod 28 is inserted into hole 52 and is rotated until the terminal end 76 of rod 28 contacts outer surface 74 of ring 64 and locks the same within advertising track 30. Thus, advertising panel 32 extends outwardly from and is securely retained by advertising track 30.

Figure 3:
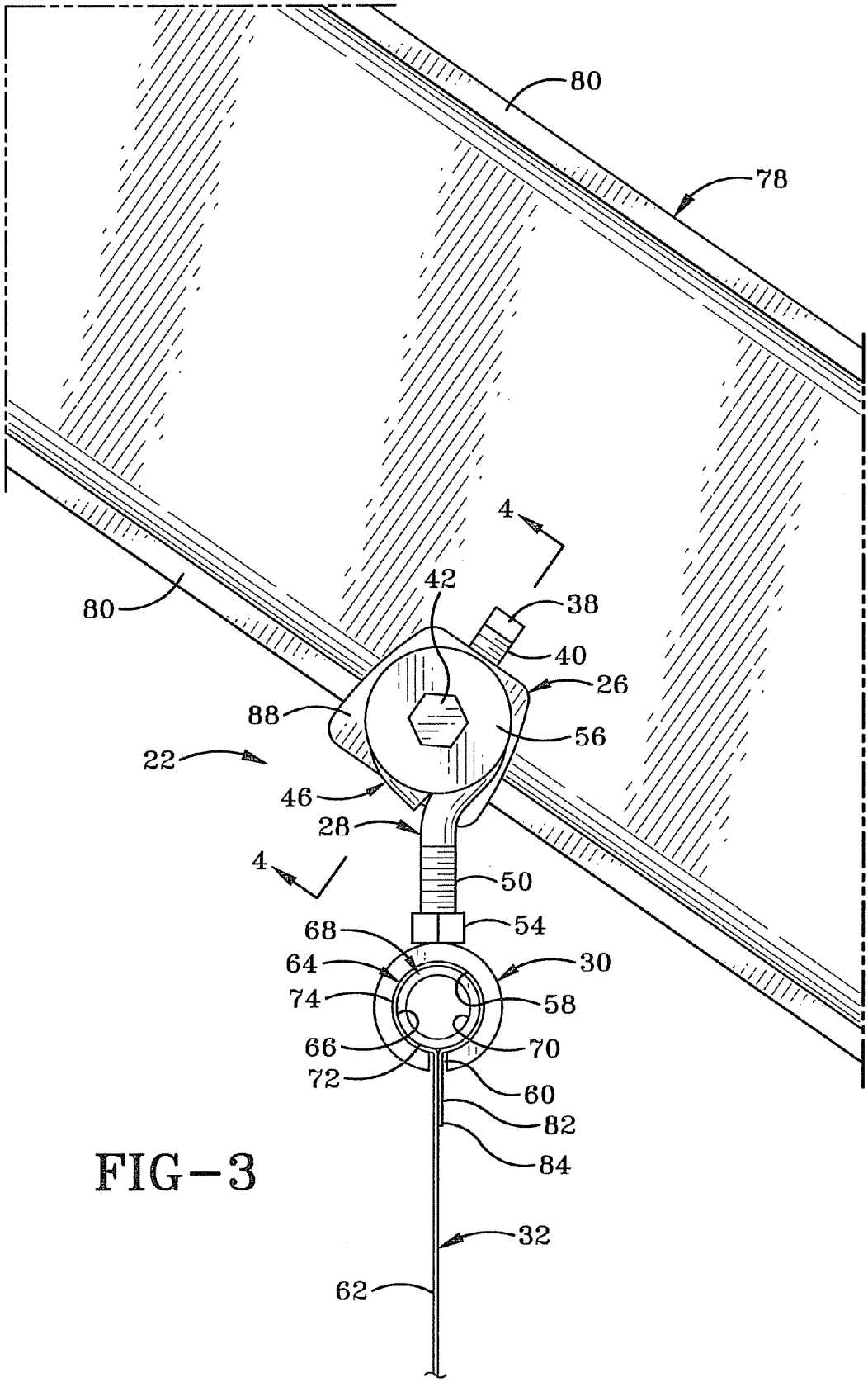
FIG. 3 is a left side elevational view of the panel fastening assembly showing a frame member secured to a beam.
Figure 4:
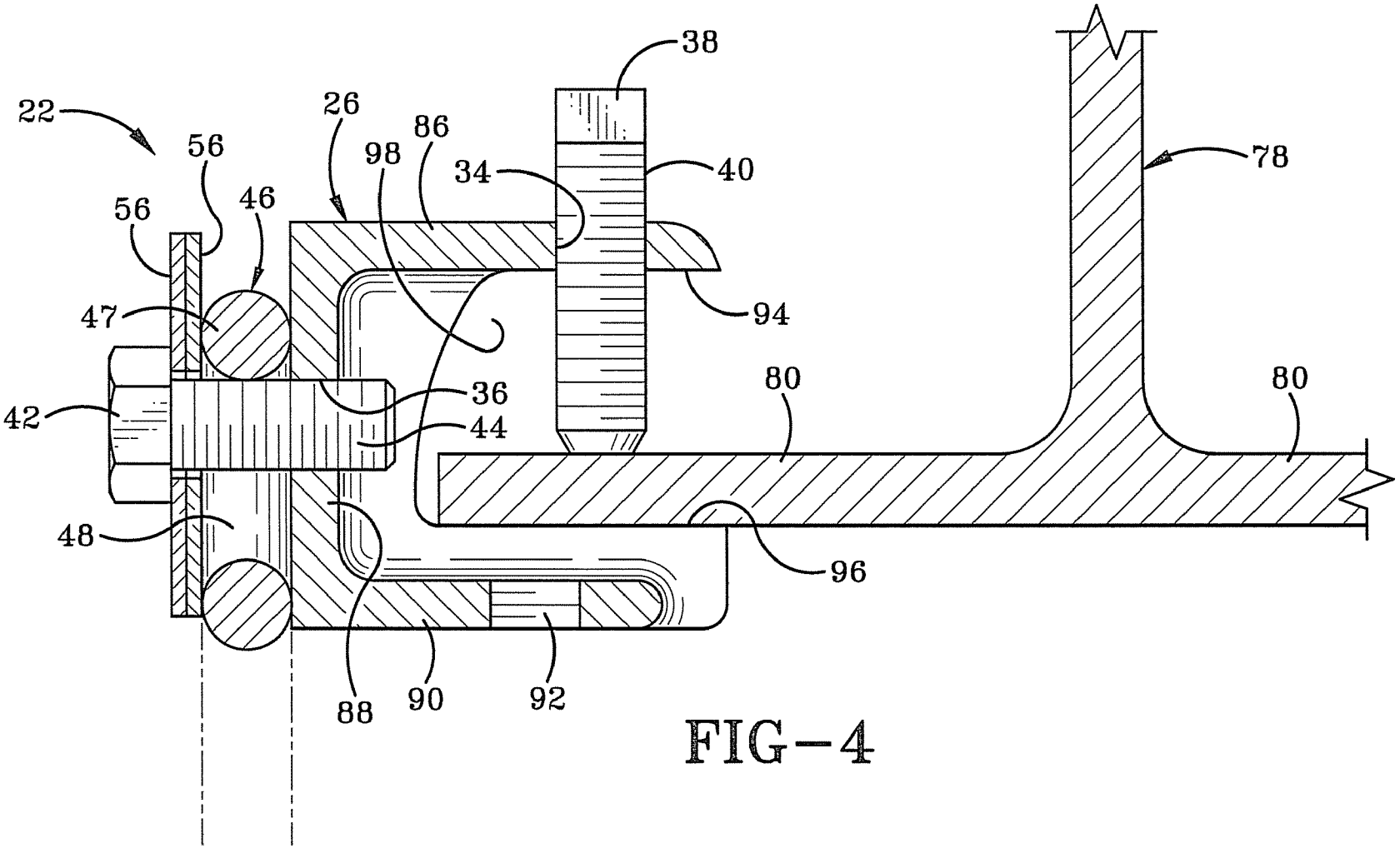
FIG. 4 is a cross-sectional view taken through line 4-4 of FIG. 3.

Referring to FIGS. 3 & 4, panel fastening assembly 22 is shown secured to a beam 78, such as the type of beam that would be present on a bleacher. Beam 78 is illustrated as being disposed at an angle to the vertical. Specifically, beam 78 may be a top rail beam arranged at an angle similar to a bleacher seating surface. Beam 78 preferably is an I-beam that includes a web having a flange 80 at the top and bottom ends of the web. As will be discussed in greater detail below, frame member 26 is arranged to be secured to one of these flanges 80. FIG. 2 shows that advertising panel 32 includes a ring 64 disposed along at least one edge. FIG. 3 shows that ring 64 is formed by folding a terminal edge of panel 32 back onto a section of panel 32 and creating a seam 82 therein. Thus, ring 64 and panel 32 are made from the same sheet material. It will be understood, however, that ring 64 may be made from a different material to panel 32 simply by securing a section of the different material to panel 32 by way of a seam. If panel 32 does not require the panel fastening assembly to be secured to a particular side of panel 32, then a ring 64 would not be formed along that side or the ring could be formed and simply not be used.

FIG. 4 illustrates an enlarged cross sectional view of panel fastening assembly 22 secured to beam 78, and to flange 80 of that beam 78, in particular. Specifically, the installer of the advertising panel system may use either of the top and bottom holes 34, 92 to secure frame member 26 to flange 80. Frame member 26 also includes an inner surface 94 of top wall 86, and an inner surface 96 of bottom wall 90. A cavity 98 is defined between inner surface 94 and inner surface 96. Each of inner surfaces 94, 96 are adapted to abut flange 80, depending on whether top hole 34 or bottom hole 92 are used to locate flange 80 within cavity 98. Specifically, bolt 38 is threaded through either top hole 34 or bottom hole 92 to engage flange 80 and thereby wedge or secure frame member 26 in abutting contact with flange 80. While the first preferred embodiment frame is shown with the inner surfaces 94, 96 being generally disposed at right angles relative to rear wall 88, flat, it is within the spirit and scope of the present invention to incline the inner surface 94 and/or the inner surface 96 relative to rear wall 88 to match the angle of flange 80 as necessary.

Having described the structure of the first preferred embodiment, a preferred method of operation will be described in detail and should be read in light of FIGS. 1 through 4. Advertising panel 32 is formed with seam 82 defining ring 64 which has inner bore 66. Carrier 68 is inserted into inner bore 66 of ring 64 and the combination thereof is inserted into chamber 58 of advertising track 30. Specifically, ring 64 is positioned within track 30 such that the advertising portion 62 of panel 32 is aligned with slot 60 in track 30 and extends outwardly therefrom.

Bolt 38 is threaded through either of top hole 34 or bottom hole 92 of frame member 26, depending on which side of the beam is most easily accessed. Frame member 26 is then positioned so that flange 80 extends into cavity 98. Bolt 38 is rotated until either inner surface 94 of top wall 86 abuts the upper surface of flange 80 or inner surface 96 of bottom wall 90 engages the bottom surface of flange 80. Bolt 38 is tightened to the point that frame member 26 cannot be pulled out of engagement with flange 80. Nut 54 may either be threadably engaged with threads 50 on the shaft of rod 28 and rotated upwardly until a portion of the tip 76 thereof extends outwardly beyond nut 54 or nut 54 may be mounted on the outer surface of track 30 adjacent hole 52 and the threaded shaft of rod 28 is screwed through into nut 54 and into hole 52.

Nut 54 is rotated to thread a length of rod 28 downwardly into chamber 58 of track 30. When a sufficient length of the shaft of rod 28 is received in chamber 58, the tip 76 will engage the exterior surface of the combined ring 64 and carrier 68 and will lock the same in place within track 30. Rod 28 is secured to frame member 26 by inserting bolt 42 through washers 56, through opening 48 and into rear hole 36 in rear wall 88 of frame member 26. Bolt 42 is rotated until rod 28 is tightly retained against rear wall 88 of frame member 26. Thus, track 30 and advertising panel 32 are securely locked to frame member 26. Frame member 26 is then secured to beam 78 as previously described.

In a similar fashion, a second advertising track (not shown) and second frame member (not shown) may be secured to an opposite end of advertising panel 32 from that shown in FIG. 1. The second frame member may also be secured to a second beam that is spaced a distance from beam 78. When the two frame members are secured to the two beams and the rods 28 of the two panel fastening assemblies retain advertising panel 32 in the two opposing tracks 30 thereof, then the advertising panel 32 is tensioned between the two panel fastening assemblies and the graphics and text of any advertising displayed on panel 32 is clearly visible.

Having described the structure and operation of the first preferred embodiment, only those portions of the second embodiment which are different from the first embodiment are described in detail. Likewise, similar numerals refer to similar parts throughout the various embodiments.

Figure 5:
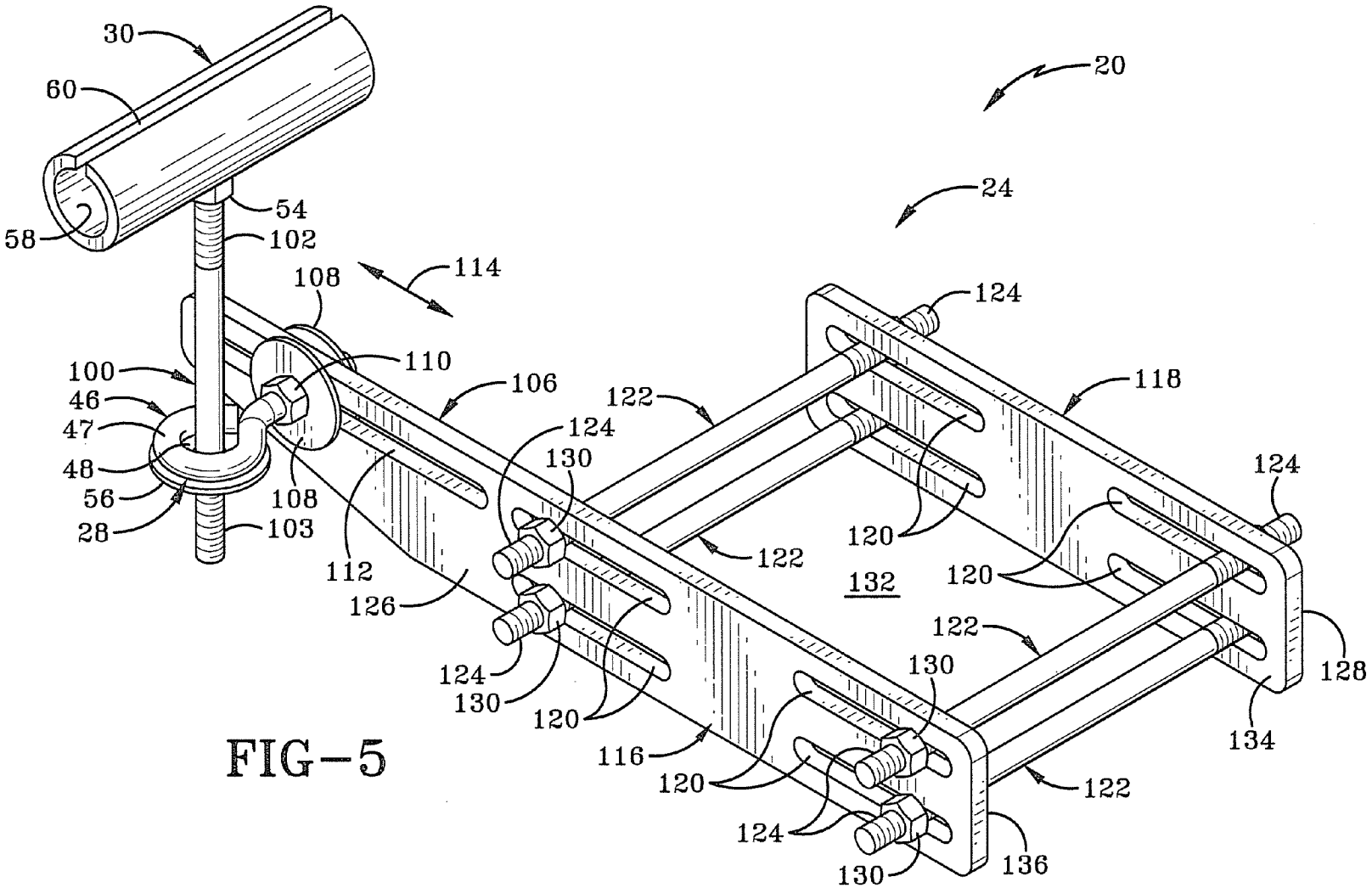
FIG. 5 is a perspective view of a second preferred embodiment of a panel fastening assembly for use in the advertising display system in accordance with the present invention shown prior to installation on a beam.
Figure 6:
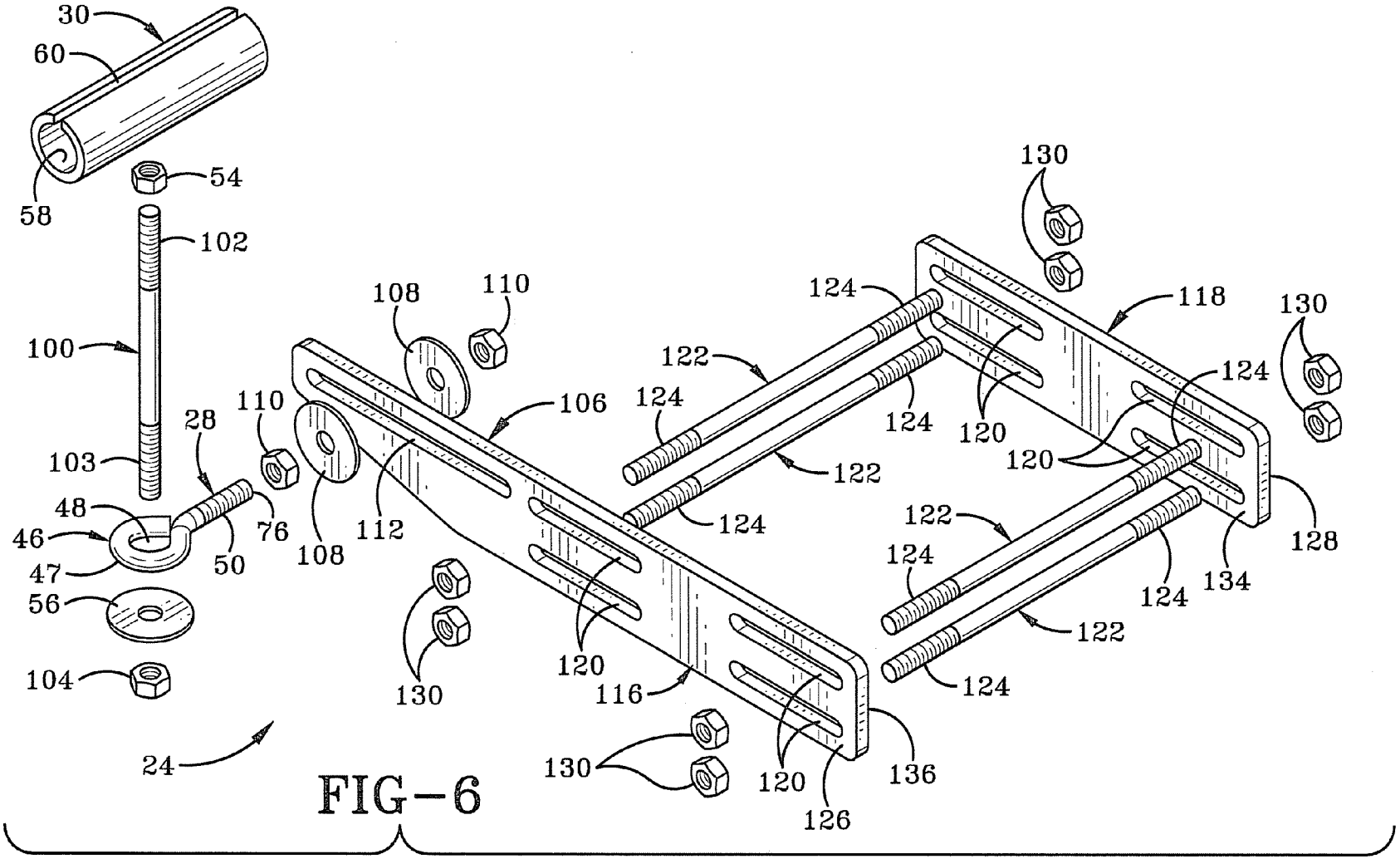
FIG. 6 is an exploded view of the panel fastening assembly of FIG. 5.

FIGS. 5 through 11 illustrate a second preferred embodiment of a panel fastening assembly in accordance with the present invention and generally referenced by the number 24. Referring specifically to FIGS. 5 and 6 and in accordance with another main feature of the invention, advertising track 30 and rod 28 are similar to the panel fastening assembly 22, but panel fastening assembly 24 further includes a second rod 100 that engages rod 28 and track 30 and is operable to vary the distance between the same. Rod 100 includes a threaded portion 102 at a first end and a threaded portion 103 at a second end. Threaded portion 102 is engaged with track 30 and lock nut 54 is used to secure that first end of rod 100 to track 30 in a similar manner as bolt 42 is secured to rod 28 in panel fastening assembly 22. Threaded portion 103 of rod 100 is received through opening 48 of rod 28, and a washer 56 and nut 104 (FIG. 6) are used to vary the distance between track 30 and rod 28, as will be described hereinafter.

Figure 7:
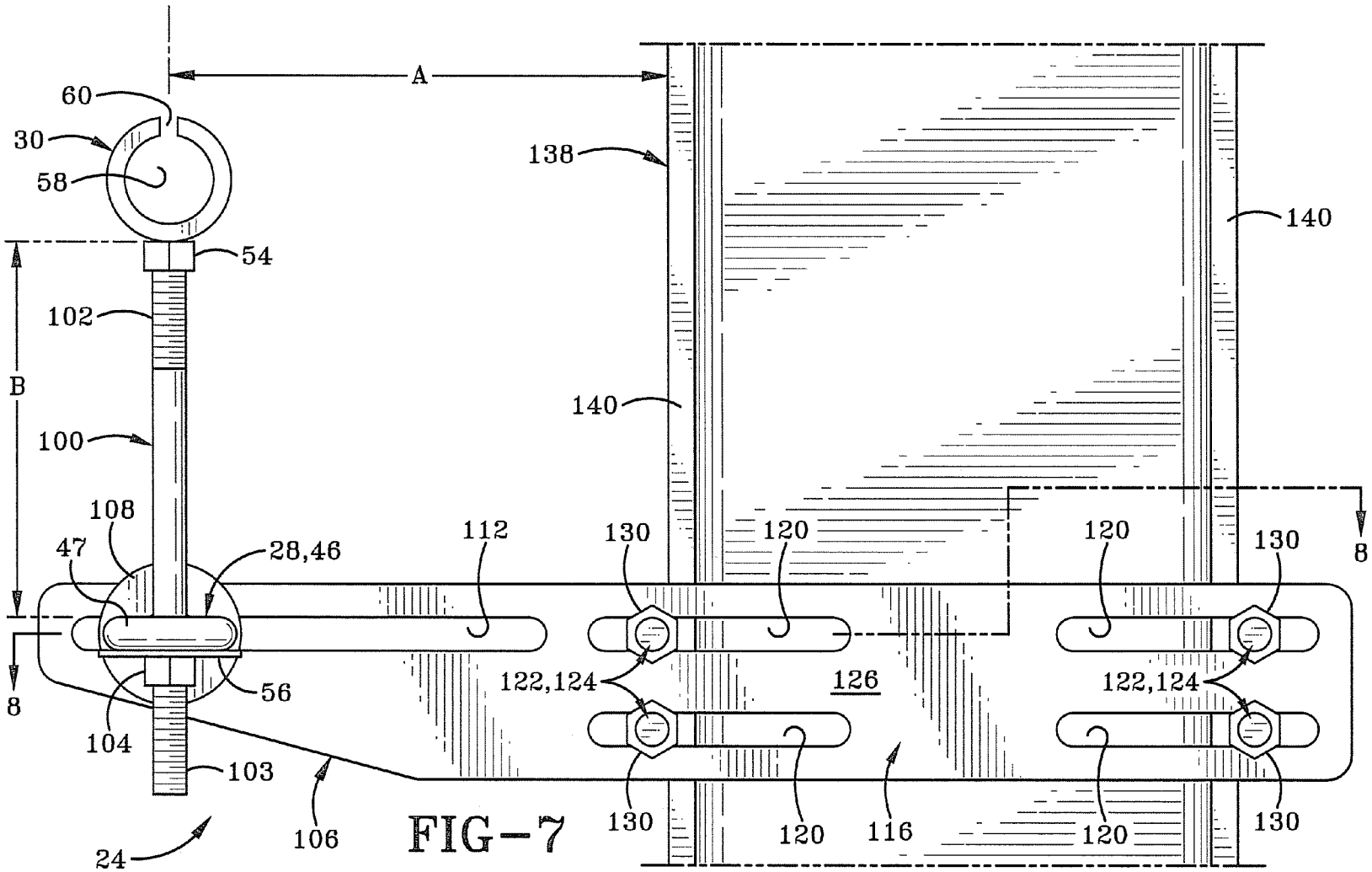
FIG. 7 is a front elevational view of the panel fastening assembly shown secured to a beam.

Panel fastening assembly 24 further includes a frame member 126 which is removably secured to a beam 138 (FIG. 7). Frame member 126 comprises a first arm 106 and a second arm 118 that are connected to each other by way of a plurality of mounting bolts 122. Rod 28 is secured to first arm 106 with a pair of washers 108 and a pair of nuts 110. Specifically, rod 28 is inserted through an elongated slot 112 in first arm 106 and nuts 110 lock the same in position. The position of rod 28 in slot 112 is adjustable as indicated by the arrows 114. In order to move rod 28 in slot 112, nuts 110 are loosened and rod 28 is slid to the desired location. Nuts 110 are then tightened to lock rod 28 in place. Thus, the position of rod 100 and, therefore the advertising track 30 is adjustable along the length of elongated slot 112. This enables the installer to locate the advertising panel (not shown in these figures) at a predetermined location relative to the beam 138.

In accordance with another feature of the present invention, first arm 106 includes a rear portion 116 that is complementary in shape and size to second arm 118. Both of the rear portion 116 and second arm 118 include a plurality of elongated slots 120. The slots 120 on rear portion 116 are aligned with the slots on second arm 118. In the preferred embodiment, four elongated slots 120 are defined, in rear portion 116 and four elongated slots 120 are defined in second arm 118. Four mounting bolts 122 are provided to secure first arm 106 and second arm 118 together. Each mounting bolt 122 preferably includes a threaded portion 124 at each end and when bolts 122 are engaged through slots 120 in first and second arms 106, 118, the threaded portion 124 extends beyond the outer surfaces 126, 128 of rear portion 116 and second arm 118, respectively. Nuts 130 are engaged with mounting bolts 122 and abut outer surfaces 126, 128. Once first and second arms 106, 118 are secured together with mounting bolts 122, a cavity 132 is defined by an inner surface 134 of second arm 118, an inner surface 136 of rear portion 116 of first arm 106, and mounting bolts 122. Since slots 120 are elongated longitudinally, the longitudinal position of mounting bolts 122 may be varied as necessary to secure frame member 126 to beam 138, as will be hereinafter described.

Figure 8:
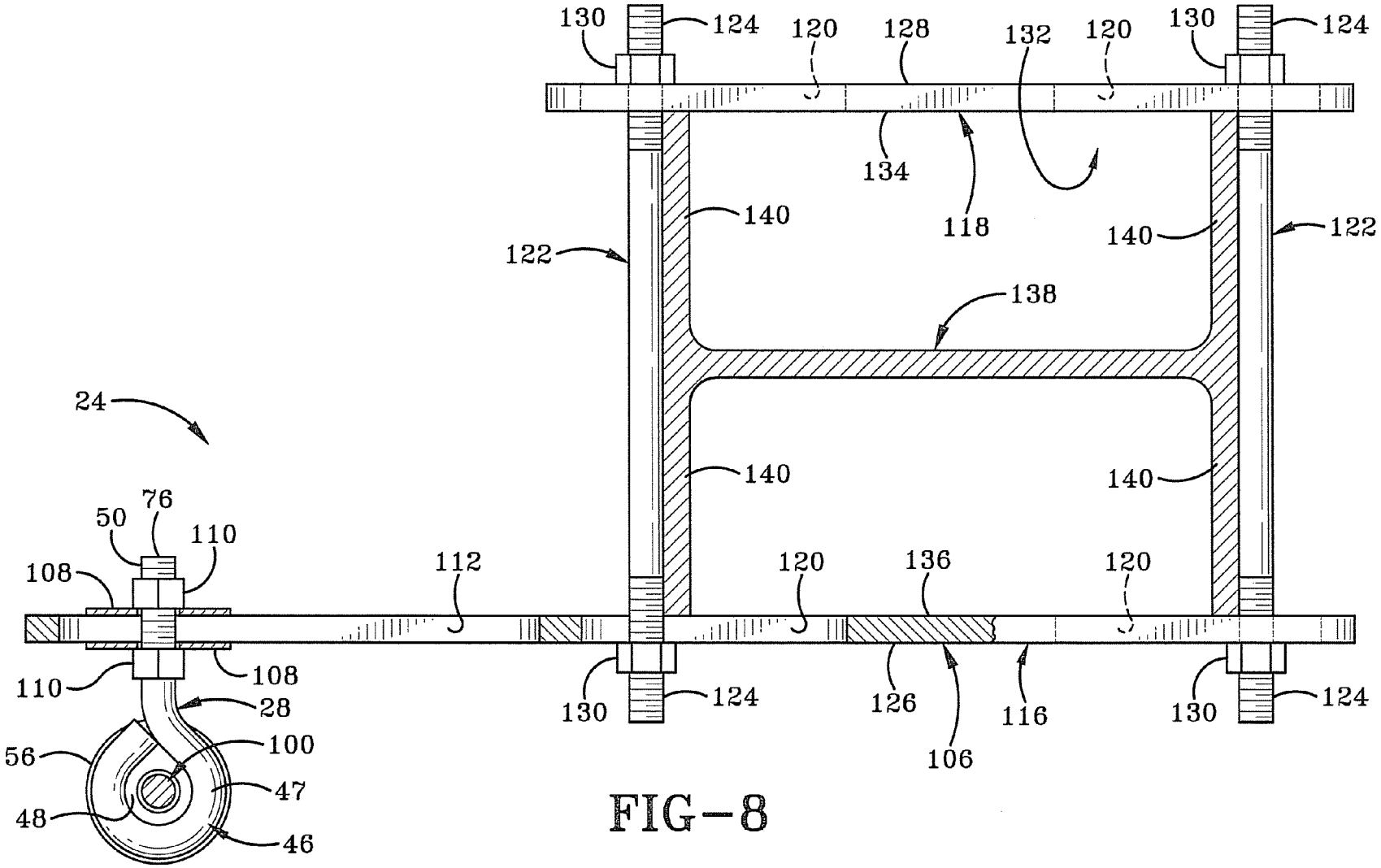
FIG. 8 is a partial cross-sectional view taken generally along line 8-8 in FIG. 7.

FIGS. 7 and 8 illustrate panel fastening assembly 24 secured around a vertical beam 138. Vertical beam 138 is an I-beam having a central web with flanges 140 at either end. Frame member 126 is engaged with beam 138 in such a manner that inner surface 136 of first arm 106 abuts the terminal ends of the flanges 140 on a first side of the web and inner surface 134 of second arm 118 abuts the terminal ends of the flanges 140 on a second side of the web. Mounting bolts 122 are adjusted within slots 120 of first and second arms 106, 118 such that a first pair of bolts 122 are disposed in abutting contact along the length of a first one of the flanges 140 and a second pair of bolts 122 are disposed in abutting contact along the length of a second one of the flanges. Nuts 130 are tightened to secure frame member 126 in place on beam 138. It will be understood that frame member 126 could be rotated through ninety degrees from the manner illustrated in FIGS. 7 & 8. In this second instance, inner surface 136 of first arm 106 would abut the length of the first one of the flanges 140 and inner surface 134 of second arm 118 would abut the length of the second one of the flanges 140. Mounting bolts 122 would engage the terminal ends of the flanges 140. In either event, beam 138 is circumscribed by frame member 126 and frame member 126 is tightly locked into position along the vertical length of the beam 138 by the cooperating nuts 130 and bolts 122. Advantageously, because mounting bolts 122 are secured with elongated slots 120, panel fastening assembly 24 can easily fit beams of various sizes.

FIGS. 7 and 8 further illustrate that the position of advertising track 30 relative to beam 138 may also be offset as desired. The distance between track 30 and beam 138 is indicated by the dimension "A" (FIG. 7). As will be evident, dimension "A" may be adjusted by sliding rod 28 along slot 112 toward or away from beam. This offset can be useful if the beam is spaced further apart from an upper beam or other attachment mechanism for the panel fastening assembly, as well as any overhanging objects that the advertising panel may cover.

The distance between advertising track 30 and frame member 126 is indicated by the dimension "B". As will be evident, dimension "B" may be adjusted by rotating nuts 54, 104 to change the length of the section of bolt 100 that extends between track 30 and rod 28. FIG. 7 illustrates the panel fastening assembly 24 in the lower mounting position. This arrangement is used for securing the bottom edge of the advertising panel (not shown). The height of advertising track 30 and the tension within the advertising panel 32 are adjusted by either tightening or loosening nut 104 on lower threaded portion 102 of the rod 100 and then extending or shortening the section of rod 100 between track 30 and rod 28.

Figure 9:
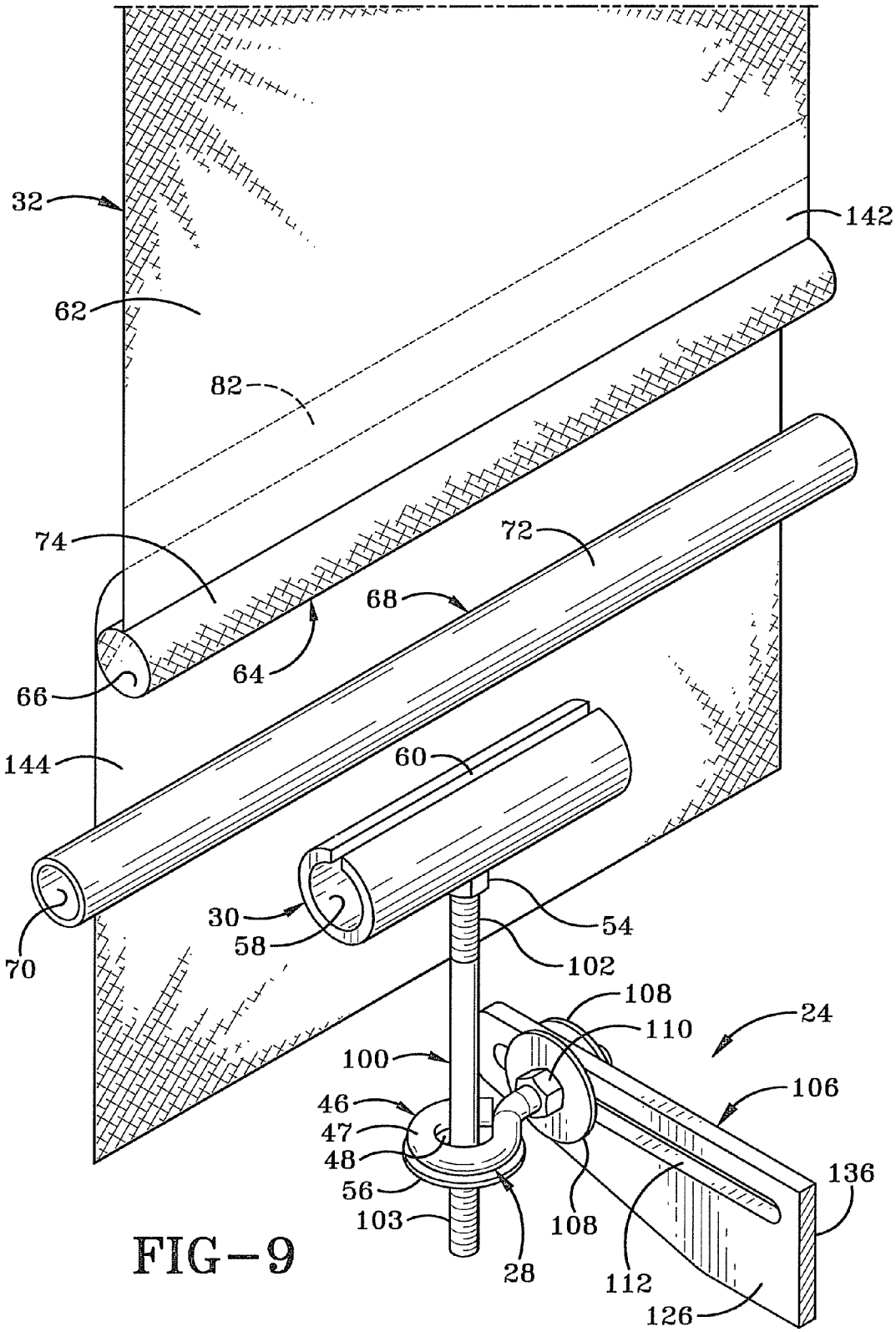
FIG. 9 is a partially exploded view of the panel fastening assembly with the carrier shown separated from the frame member and the advertising panel.
Figure 10:
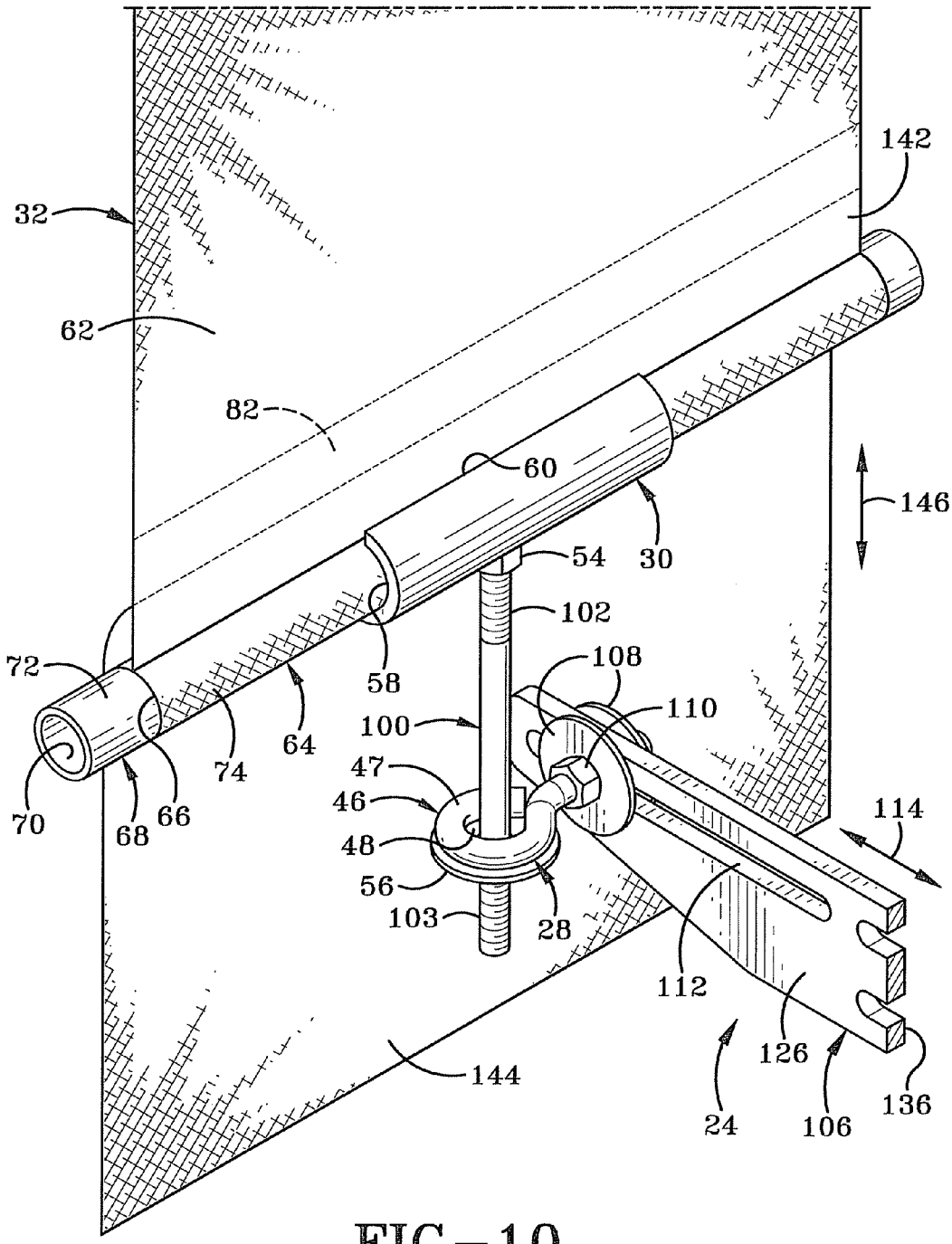
FIG. 10 is a perspective rear view of the panel fastening assembly retaining an advertising panel therein and showing the adjustability of the frame member.

The securement of a bottom end of an advertising panel 32 with panel fastening assembly 24 is illustrated in FIGS. 9 and 10. Advertising panel 32 includes an advertising portion 62 and has a seam 82 formed along its lower end 142. Seam 82 secures a folded region of the lower end of panel 32 back on itself to form ring 64. Additionally, a skirt portion 144 of panel 62 is secured to advertising portion 62 along seam 82. Ring 64 formed on lower end 142 of advertising portion 62 has an outer surface 74 and defines an inner bore 66. As was the case with the first preferred embodiment of the invention, carrier 68 is inserted into inner bore 66 of ring 64 in such a manner that the outer surface 72 of carrier 68 abuts an interior surface of ring 64. Carrier 68 defines a passage 70 therein. The combined carrier 68 and advertising panel 32 are engaged within chamber 58 of advertising track 30 as described with reference to the first preferred embodiment. Consequently, when track 30 is so engaged, advertising portion 62 of panel 32 extends outwardly and upwardly through slot 60 of track 30. Skirt panel 144 hands downwardly from lower end 142 of panel 62 and effectively hides all the components of panel fastening assembly 24 from view. Nut 54 is rotated to lock the combined carrier 68 and panel 32 to advertising track 30.

FIG. 10 illustrates, advertising panel 32 engaged with panel fastening assembly 24. Although not illustrated herein, it will be understood that beam 138 is disposed substantially parallel to advertising panel 32 and surrounded by the rear portion 116 of first arm 106 and second arm 118 (not shown in this figure) of frame member 126. It should be noted that when panel fastening assembly 24 is being used to secure advertising panel 32 to a beam, the frame member 126 is positioned vertically beneath advertising track 30. Advertising panel 32 may be drawn closer to the beam or moved further away therefrom by longitudinally adjusting the position of rod 28 in slot 112, as indicated by arrows 114. Additionally, the tension in advertising panel 32 may be adjusted in the directed indicated by arrows 146. The tension is adjusted by changing the relative distance between track 30 and rod 28 by rotating the nut 104 (not shown in these figures) as described with reference to the first preferred embodiment of the invention. Ideally, the tension is adjusted until the advertising panel 32 is pulled substantially taut and free of wrinkles.

Figure 11:
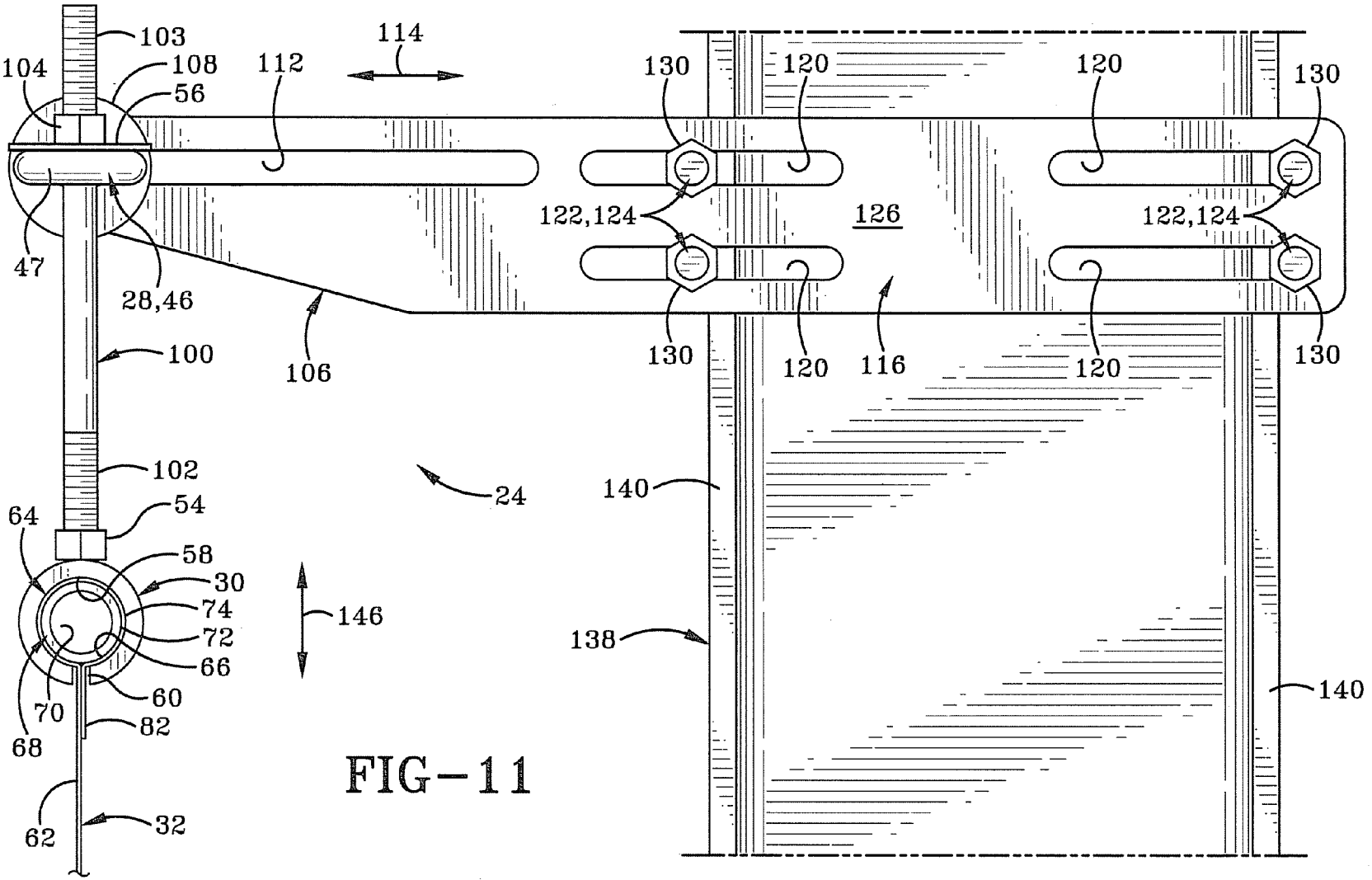
FIG. 11 is a right side elevational view of the panel fastening assembly installed on the beam.

FIG. 11 illustrates panel fastening assembly 24 arranged to secure the top end of advertising panel 32 to the vertical beam 138. In this instance, frame member 126 is positioned vertically above advertising track 30 and advertising panel 32 hangs downwardly from advertising track 30. As was the case with respect to FIGS. 9 & 10, this relative distance between panel 32 and beam 138 is adjusted by sliding rod 28 horizontally along slot 112 in the directions indicated by arrow 114. The vertical distance of advertising panel 32 from frame member 126 is adjusted by rotating nut 104 to effectively lengthen or shorten rod 100 in the directions indicated by the arrows 146. Thus the operator can adjust the tension in the advertising panel 32 by rotating nut 104.

Having described the structure of the second preferred embodiment of the panel fastening assembly 24 in accordance with the present invention, a preferred method of operation will be described in detail and should be read in light of FIGS. 5 through 11. Due to the fact that advertising panel 32 remains virtually identical within both of the first and second preferred embodiments of the invention, with the addition of skirt panel 144 (which does not change the operation of the panel fastening assembly), the attachment of the advertising panel 32 to the advertising track 30 will not be described again as it is identical to that discussed above. Further, the manner of tensioning and positioning of the second preferred embodiment is substantially identical to the first preferred embodiment.

Panel fastening assembly 24 is secured to beam 138 in the following manner. First arm 106 and second arm 118 are arranged on opposite sides of vertical beam 138 and the plurality of mounting bolts 122 are inserted through elongated slots 120. Mounting bolts 122 are secured in place around vertical beam 138 with nuts 130 to form a cavity 132. Vertical beam 138 is retained within this cavity 132. Rod 28 is inserted into elongated slot 112 in first arm 106 and washers 56 and nuts 110 are finger tightened. The position of rod 28 in slot 112 is adjusted and then nuts 110 are rotated to lock rod 28 against further movement in slot 112. Rod 100 is inserted through opening 48 in rod 28. Nut 104 is rotated to adjust the position between track 30 and rod 28. Nut 104 is rotated in a first direction to decrease the distance between track 30 and rod 28 and thereby increase the tension on panel 32. Nut 104 is rotated in a second direction to increase the distance between track 30 and rod and thereby decrease the tension on panel 32. The remainder of the installation is similar to that of the first preferred embodiment. Once again, carrier 68 is inserted within inner bore 66 of ring 64 and the combination is then engaged within advertising track 30 such that advertising portion 62 extends outwardly through slot 60 of track 30. In the installation of track 30 at the bottom end of advertising panel 32, skirt panel 144 hangs downwardly to hide ring 64 and frame member 26.

Having described the structure and operation of the two preferred embodiment panel fastening systems, a preferred embodiment advertising display will now be described in detail. Similar numerals refer to similar parts throughout the various embodiments.

Figure 12:
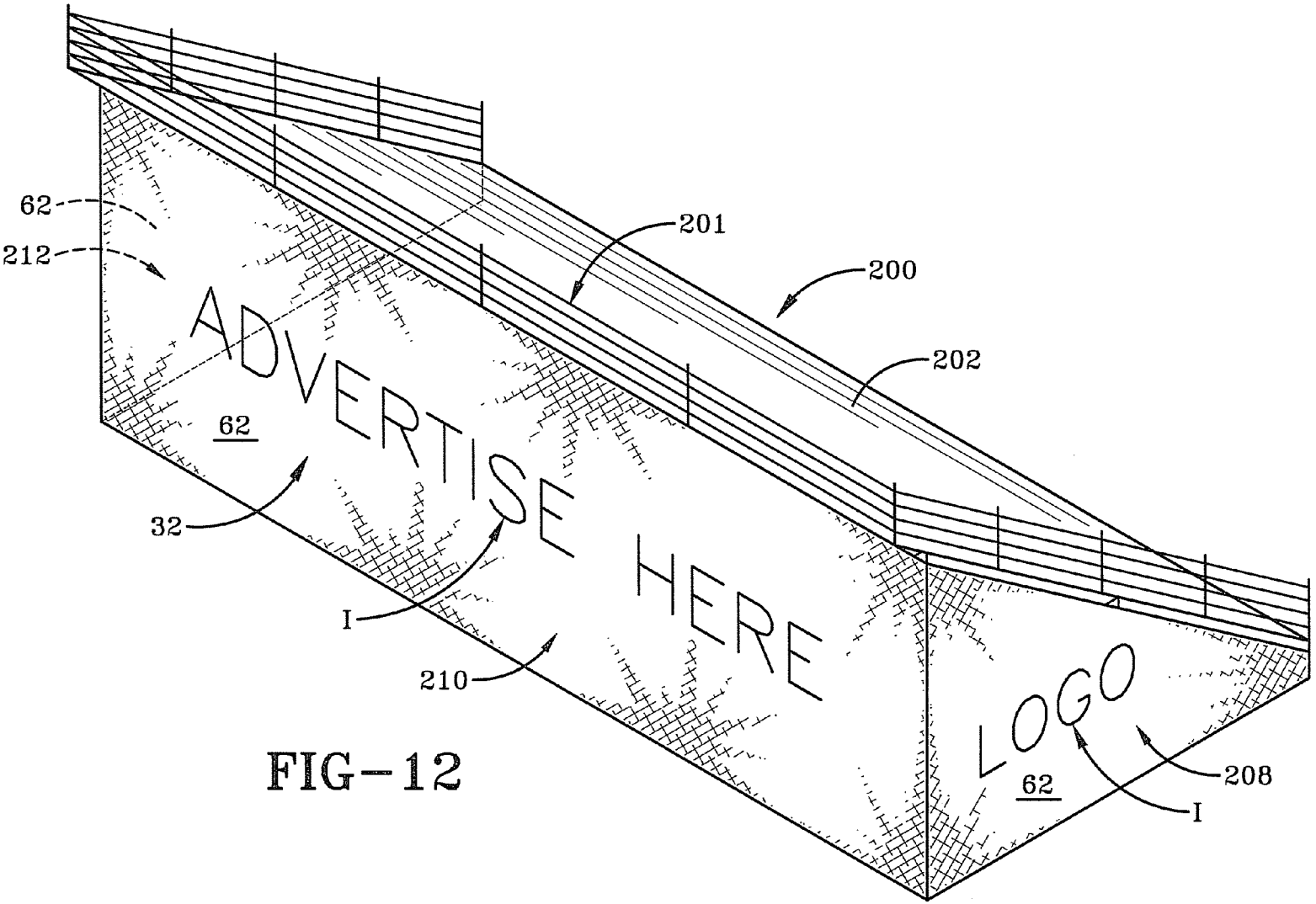
FIG. 12 is a perspective view of a bleacher advertising display system in accordance with the present invention, including an advertising panel disposed adjacent an external region of the left side, the right side, and the rear of a bleacher.
Figure 13:
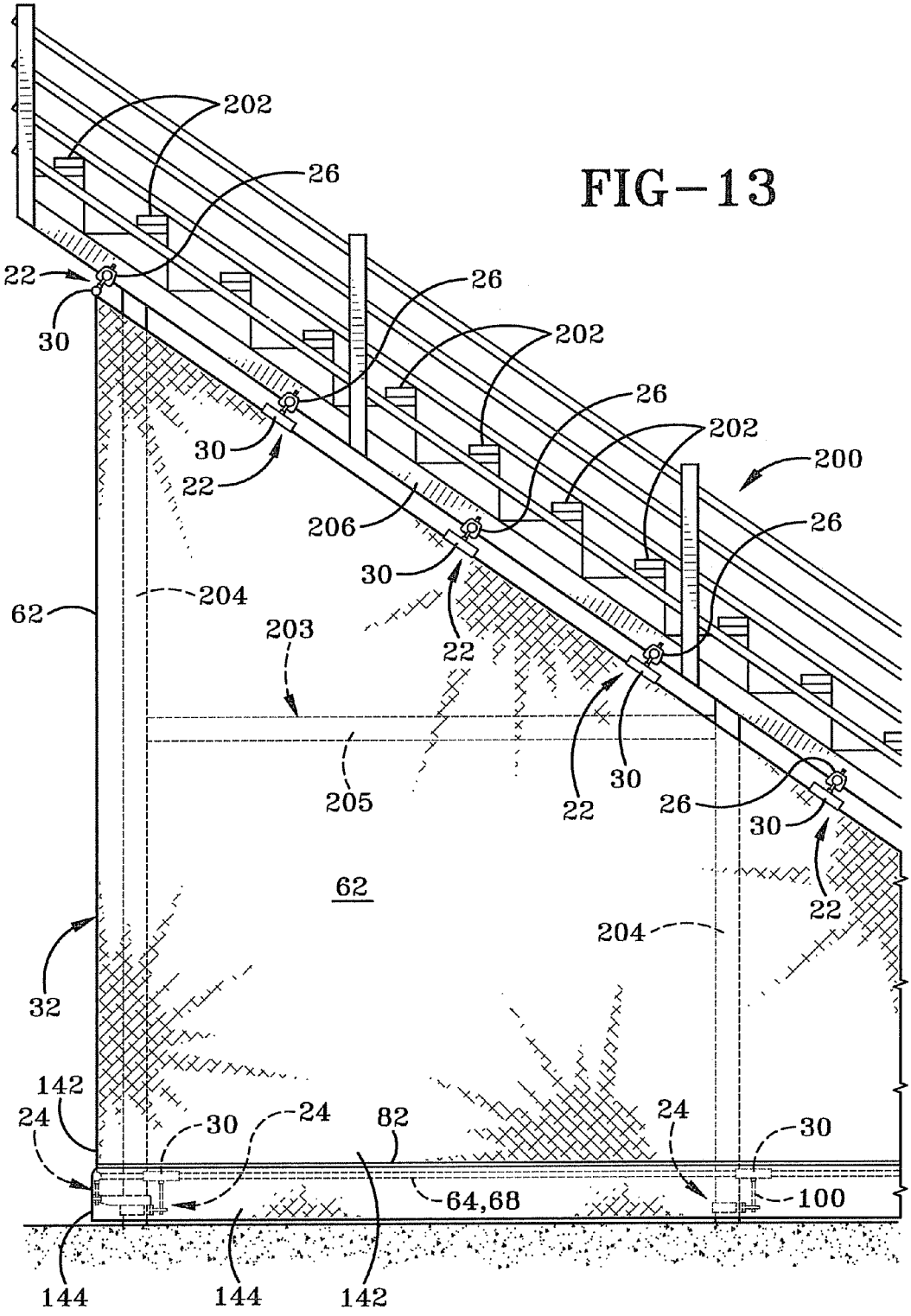

FIGS. 12 and 13 illustrate advertising panel 32 secured to a bleacher assembly 200. Bleacher assembly 200 includes a seating surface 202 and a support structure 203 made up of a grid of vertical beams 204, horizontal beams 205 and angled beams 206. FIG. 12 illustrates one or more advertising panels 32 and specifically the advertising portions 62 thereof extending downwardly from an upper end of seating surface 202 toward a bottom end of the support structure 203. The upper end of the advertising panel 32 is secured to support structure 203 by one or more panel fastener assemblies, such as assemblies 22 and 24. The lower end of advertising panel 32 is secured to support structure 203 by one or more other panel fastener assemblies 22 or 24. Preferably, the upper end of panel 32 is secured to bottom rail 206 of seating surface 202 by frame members 26 and advertising track 30 of panel fastening assemblies 22.

Advertising panel 32 may be utilized to enclose one or more of a right side region 208 of bleacher 200, a rear side 210 thereof, and a left side region 212 of bleacher 200. While the preferred embodiment advertising display includes three sides of bleacher 200 covered with one or more advertising panels 32, it is within the spirit and scope of the present invention as claimed to locate the advertising panel on only a single side, or a combination of the three sides. Further, the advertising panel may be displayed along only a portion of the bleacher such as only the middle of the rear side.

FIG. 12 illustrates advertising panel 32 with printed indicia "I" displayed along an external vertical surface of the bleacher assembly on three sides. The indicia "I" may be continuous along all three panels or could be different on each panel. Furthermore, indicia "I" may be provided on both an interior and exterior surface of panel 32 so that advertisements are visible through gaps in seating surface 202.

Figure 12A:
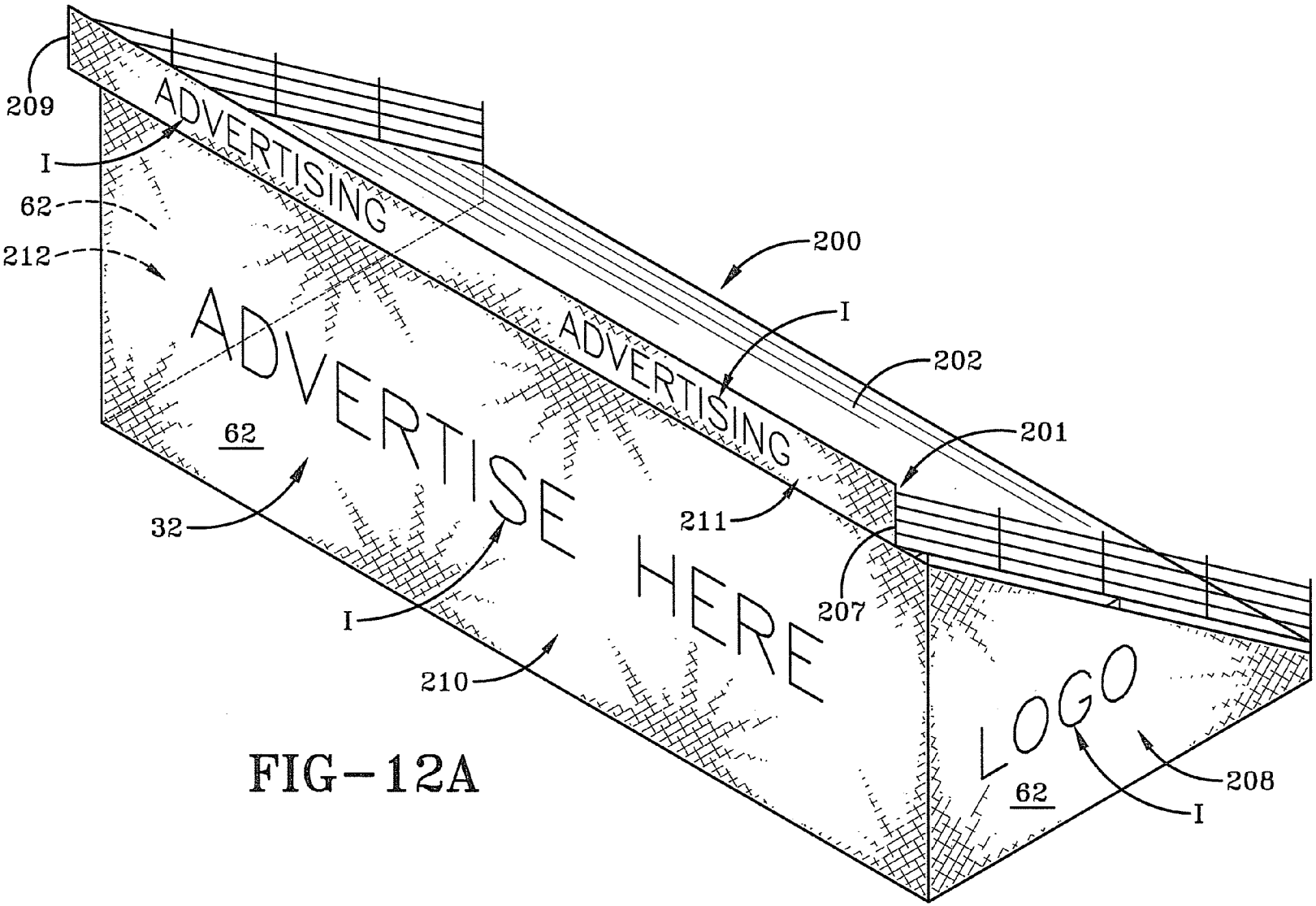
FIG. 12A is a perspective view of the bleacher advertising display system of FIG. 12 and further including an advertising panel disposed adjacent a rear bleacher support rail; and, FIG. 13 is a right side view of the bleacher advertising display system showing the advertising panel secured to the bleacher support beams along a top end and a bottom end of the advertising panel with portions of the support beams and mounting frames shown in dashed lines.

FIG. 12A shows a support rail 201 extending upwardly from a top end of bleacher 200 along the back and sides thereof. Support rail 201 provides a support structure onto which an additional advertising panel 211 may be secured using one of the panel fastening assemblies as previously described. In this instance, advertising panel 211 preferably extends across the front and rear surfaces of the back support rail 201. Panel 211 may be wrapped around back support rail 201 and extend from a first end 207 to a second end 209 thereof. Advertising panel 211 presents an advertising surface thereon and upon which advertising indicia "I" may be displayed. These indicia may be the same or different to those provided on panel 62. Furthermore, advertising panel 211 may be continuous with panel 62 or may be separate therefrom. Further, advertising panels 211 and 62 are easily removable from bleacher 200 to permit various advertisers to purchase advertising space on bleacher 200 on a monthly or yearly basis for example.

FIG. 13 illustrates a plurality of panel fastening assemblies 22 secured at intervals to bottom rail 206. As previously described, each panel fastening assembly includes a frame member 26 and advertising track 30 which interlockingly engage a top edge of advertising panel 32. A plurality of panel fastening assemblies 24 are secured to vertical support posts 204 at a position proximate to a bottom edge of advertising panel 32. Each panel fastening assembly 24 includes an advertising track 30 that engages a carrier 68 disposed in a ring 64 formed along a lower end 142 of panel 32. Rods 100 are provided to help the installer adjust the relative positions of the various components of panel fastening assemblies 24 so that advertising panel 32 is correctly tensioned. When panel 32 is correctly tensioned, there will be substantially no wrinkles in panel 32 which will then present an aesthetically pleasing advertising surface upon which the indicia "I" will be clearly visible.

As illustrated in FIG. 13, advertising panels 32 are provided on both the rear side and right side of bleacher 200. Thus, a plurality of panel fastening assemblies 22 are engaged with the bleacher support structure along the rear side of the bleacher. A second plurality of panel fastening assemblies 22 are engaged with the bleacher support structure along the right side of the bleacher. The panel fastening assemblies along the rear side are disposed substantially at right angles to the panel fastening assemblies along the right side (and left side) of the bleacher. Similarly, panel fastening assemblies 24 secured to the support structure on the rear side of bleacher 200 are generally disposed at right angles to the panel fastening assemblies 24 that are secured to the support structure along the left and right sides of bleacher 200.

It should further be understood that panel fastening assemblies 24 could be used to secure the top end of the advertising panel 32 and panel fastening assemblies 22 could be used to secure the lower end 142 of advertising panel 32 or a combination of the two panel fastening assemblies 22, 24 could be used along either or both of the top and lower ends of panel 32.

Although it has not been illustrated herein, it should be understood that panel frame assemblies 22, 24 could alternatively be mounted to support structure 203 in such a fashion that they will be able to engage a side edge of advertising panel 32 instead of the upper and lower end 142 thereof. In this instance, ring 64 will be formed along the side edge of panel 32, carrier 68 will be inserted into the ring 64 on the side edge and then advertising track 30 will engage carrier 68. Additionally, panel frame assemblies 22, 24 could be adjusted in the manners previously described to maintain tension on advertising panel in a horizontal direction. It should further be understood that panel frame assemblies 22, 24 could be positioned in such a manner as to engage each of the top end, lower end 142 and side edges of advertising panel 32. In this instance, essentially the entire perimeter of panel 32 is supported by panel frame members 22, 24 and the adjustability of those frame members will permit tension in both the vertical and horizontal directions to be adjusted and maintained.

Accordingly, the bleacher advertising display is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

Having now described the features discoveries, and principles of the invention, the manner in which the bleacher advertising display is construed and used, the characteristics of the construction, and the advantageous new and useful results obtained; the new and useful structures, devices, elements, arrangement, parts, and combinations are set forth in the appended claims.

The invention claimed is:

1. An advertising display system comprising:

a bleacher having a seating surface;

a plurality of support beams supporting the seating surface, said support beams defining an exterior vertical surface on the bleacher;

an advertising panel having advertising indicia thereon;

a carrier engageable with the advertising panel;

a frame member releasably mounted to the support beams and connected to the carrier so that the advertising panel extends along the external vertical surface; and wherein the vertical surface is one or more of a left side, a right side and a rear side of the bleacher, and wherein the advertising panel is a continuous unit displayed on all of the left side, right side and rear side of the bleacher.

2. The advertising display system of claim 1, wherein the indicia are displayed on an exterior surface of the advertising panel.

3. The advertising display system of claim 2, wherein the indicia are also displayed on an interior surface of the advertising panel.

4. The advertising display system of claim 1, wherein the advertising panel comprises more than one panel member.

5. The advertising display system of claim 1, wherein the first frame members is secured to a top end of the support, and a second frame member is secured to a bottom end of the support beam, and the first frame member secures a top end of the advertising panel to the bleacher and the second frame member secures a lower end of the advertising panel to the bleacher.

6. The advertising display system of claim 5, wherein one or both of the first and second frame members are adjustable to maintain tension in the advertising panel.

7. The advertising display system of claim 1, wherein a plurality of first frames are secured to the top ends of the support beams, and a plurality of second frame members are secured to the lower ends of the support beams, and one or more of the first and second frame members are adjustable to maintain tension in the advertising panel.

8. The advertising display system of claim 1, wherein the frame member is adjustable in a direction generally perpendicular to a longitudinal axis of the advertising panel and the frame member.

9. The advertising display system of claim 1, further comprising:

an advertising track engageable with the carrier; and a rod mating the frame member and the advertising track, wherein the rod is removably secured to the advertising track.

10. The advertising display system of claim 9 wherein the advertising track includes a chamber and the carrier is slidable within the chamber.

11. The advertising display system of claim 9, wherein the advertising track defines a chamber therein, said chamber being complementary to an exterior surface of the carrier; and wherein the advertising track further defines a slot that is in communication with the chamber; and when said carrier and advertising panel are received in the chamber, a portion of the advertising panel extends outwardly through the slot.

12. The advertising display system of claim 11, wherein the carrier is releasably locked to the advertising track.

13. The advertising display system of claim 12, wherein the rod releasably locks the carrier to the advertising track.

14. The advertising display system of claim 13, wherein the rod is threaded and the advertising track includes a threaded hole for receiving the threaded rod and wherein the rod is rotated in a first direction to engage the carrier to lock the carrier to the advertising track, and is rotated in a second direction to release the carrier and thereby unlock the carrier from the advertising track.

15. A method of displaying advertising comprising the steps of:

providing an advertising panel with advertising indicia thereon;

engaging the advertising panel with a carrier;

attaching a frame member to an external vertical surface of a bleacher, where the vertical surface is defined by a plurality of support beams;

attaching a rod to the frame member;

coupling an advertising track to the carrier when engaged with the advertising panel; and securing the advertising track to the rod;

rotating the rod in a first direction to lock the carrier and engaged advertising panel to the advertising track; and tensioning the advertising panel by decreasing the length of the rod between the frame member and the advertising track.

16. The method of claim 15, wherein the step of attaching the frame member to the support beams comprises the step of wedging a portion of the frame against the support beam with a fastener.

17. An advertising display system comprising:

a bleacher having a seating surface;

a plurality of support beams supporting the seating surface, said support beams defining an exterior surface on the bleacher;

an advertising panel having advertising indicia thereon;

a carrier engageable with the advertising panel;

an advertising track engageable with the carrier;

a frame member releasably mounted to the support beams; and a rod connecting the frame member and the advertising track, and configured to lock the carrier to the advertising track wherein the advertising panel extends along the exterior surface of the bleacher; and wherein the rod is adjustable to tension the advertising panel; wherein the rod is threaded and the advertising track includes a threaded hole for receiving the threaded rod and wherein the rod is rotated in a first direction to engage the carrier to lock the carrier to the advertising track, and is rotated in a second direction to release the carrier and thereby unlock the carrier from the advertising track.

18. The advertising display system of claim 17, wherein the advertising panel comprises more than one panel member.

19. The advertising display system of claim 17, wherein the advertising track includes a chamber and the carrier is slidable within the chamber.

20. The advertising display system of claim 17, wherein the advertising track defines a chamber therein, said chamber being complementary to an exterior surface of the carrier; and wherein the advertising track further defines a slot that is in communication with the chamber; and when said carrier and advertising panel are received in the chamber, a portion of the advertising panel extends outwardly through the slot.

21. The advertising display system of claim 17, wherein the rod releasably locks the carrier to the advertising track.

* * * * *